US006666696B1

(12) United States Patent
Wu

(10) Patent No.: US 6,666,696 B1
(45) Date of Patent: Dec. 23, 2003

(54) ELECTRICAL CONNECTOR WITH IMPROVED GROUNDING TERMINAL ARRANGEMENT

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/217,382

(22) Filed: Aug. 12, 2002

(51) Int. Cl.[7] ..... H01R 4/66
(52) U.S. Cl. ..... 439/108; 439/608
(58) Field of Search ..... 439/108, 608, 439/101, 682, 696, 731, 476.1

(56) References Cited

U.S. PATENT DOCUMENTS 6,053,751 A * 4/2000 Humphrey ..... 439/108
6,183,302 B1 2/2001 Daikuhara et al.
6,368,121 B1 * 4/2002 Ueno et al. ..... 439/108

OTHER PUBLICATIONS

An InfiniBand™ Technology Overview http://www.infinibandta.org/ibta/.

* cited by examiner

*Primary Examiner*—Renee Luebke
*Assistant Examiner*—Felix O. Figueroa
(74) *Attorney, Agent, or Firm*—Wei Te Chung

(57) ABSTRACT

An electrical connector (1) comprises a bottom housing (3), an upper housing (2) and a terminal module (4). The upper housing and the bottom housing together define a space and a mating port (20) positioned near the space. The terminal module has a base (40), a tongue (41) extending in the mating port from the base in a mating direction, and a plurality of signal terminals (7, 8) and grounding terminals (5, 6) therein. The grounding terminals consist of first grounding terminals (5) for engaging with a mating connector and second grounding terminals (6) for shielding the signal terminal.

10 Claims, 6 Drawing Sheets

ELECTRICAL CONNECTOR WITH IMPROVED GROUNDING TERMINAL ARRANGEMENT

CROSS-REFERENCE TO RELATED APPLICATIONS

This application is related to U.S. patent application Ser. No. 10/215,535, filed on Aug. 9, 2002 and entitled "ELECTRICAL CONNETOR WITH IMPROVED GROUNDING TERMINAL ARRANGEMENT", U.S. Pat . No. 6,589,066, filed on Jul. 30, 2002 and entitled "ELECTRICAL CONNECTOR HAVING AN LATCHING MECHANISM", U.S. Pat. Application with unknown Serial number and filed on Jul. 17, 2002, and entitled "ELECTRICAL CONNECTOR ASSEMBLY", which are all assigned to the common assignee and which are hereby fully incorporated by reference.

BACKGROUND OF THE INVENTION

1. Field of the Invention

The present invention relates to an electrical connector, and in particular to an electrical connector which provides adequate grounding protection for signal transmission.

2. Description of Related Art

With the development of communication and computer technology, high density electrical connectors with conductive elements in a matrix arrangement are desired to construct a large number of signal transmitting paths between two electronic devices. Such high density electrical connectors are widely used in internal connecting systems of severs, routers and the like devices requiring high speed data processing and communication.

U.S. Pat. No. 6,183,302 issued to Fujitsu Co. Ltd. and on Feb. 6, 2001 discloses a high density connector which includes a dielectric housing, a plurality of signal and grounding contacts alternately disposed in the dielectric housing. Each of the grounding contacts, shaped in a plate-like, is a single piece and has a contact beam inserted through the dielectric housing for engaging with a complementary connector. Such a grounding contact is simple in structure and in assembly, but the contact beam thereof is easily deformed or damaged during assembly, thereby adversely affecting the electrical connection with the complementary connector. Thus, effective grounding function of the grounding contacts cannot be ensured.

It is thus desirable to have an electrical connector which can more efficiently provide grounding function.

SUMMARY OF THE INVENTION

Accordingly, an object of the present invention is to provide an electrical connector which can satisfy the grounding needs of application.

In order to achieve the objects set forth, an electrical connector in accordance with the present invention comprises a bottom housing, an upper housing and a terminal module. The upper housing and the bottom housing together define a space and a mating port positioned near the space. The terminal module has a base, a tongue extending in the mating port from the base in a mating direction, and a plurality of signal terminals and grounding buses therein. The grounding buses consist of first grounding terminals for engaging with a mating connector and second grounding terminals for shielding the signal terminals.

Furthermore, the tongue defines a plurality of through grooves and grooves arranged alternately to each other. The base defines a plurality of passageways communicating with the through grooves to receive the grounding buses, and passages communicating with the grooves to receive the signal terminals. The terminal module may comprise a circuit board for engaging with the first grounding terminals and signal terminals.

Other objects, advantages and novel features of the invention will become more apparent from the following detailed description when taken in conjunction with the accompanying drawings.

DETAILED DESCRIPTION OF THE INVENTION

Figure 1:
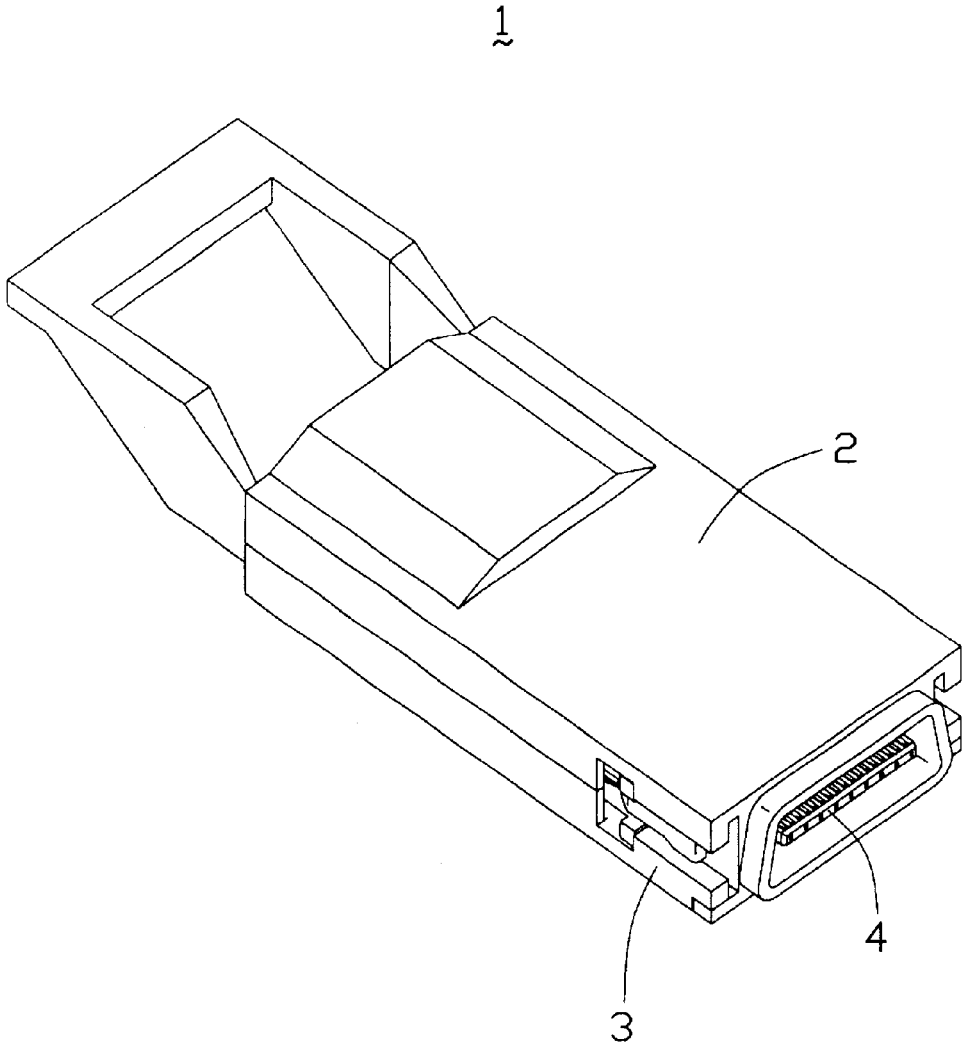
FIG. 1 is a perspective view of an electrical connector in accordance with the present invention.
Figure 2:
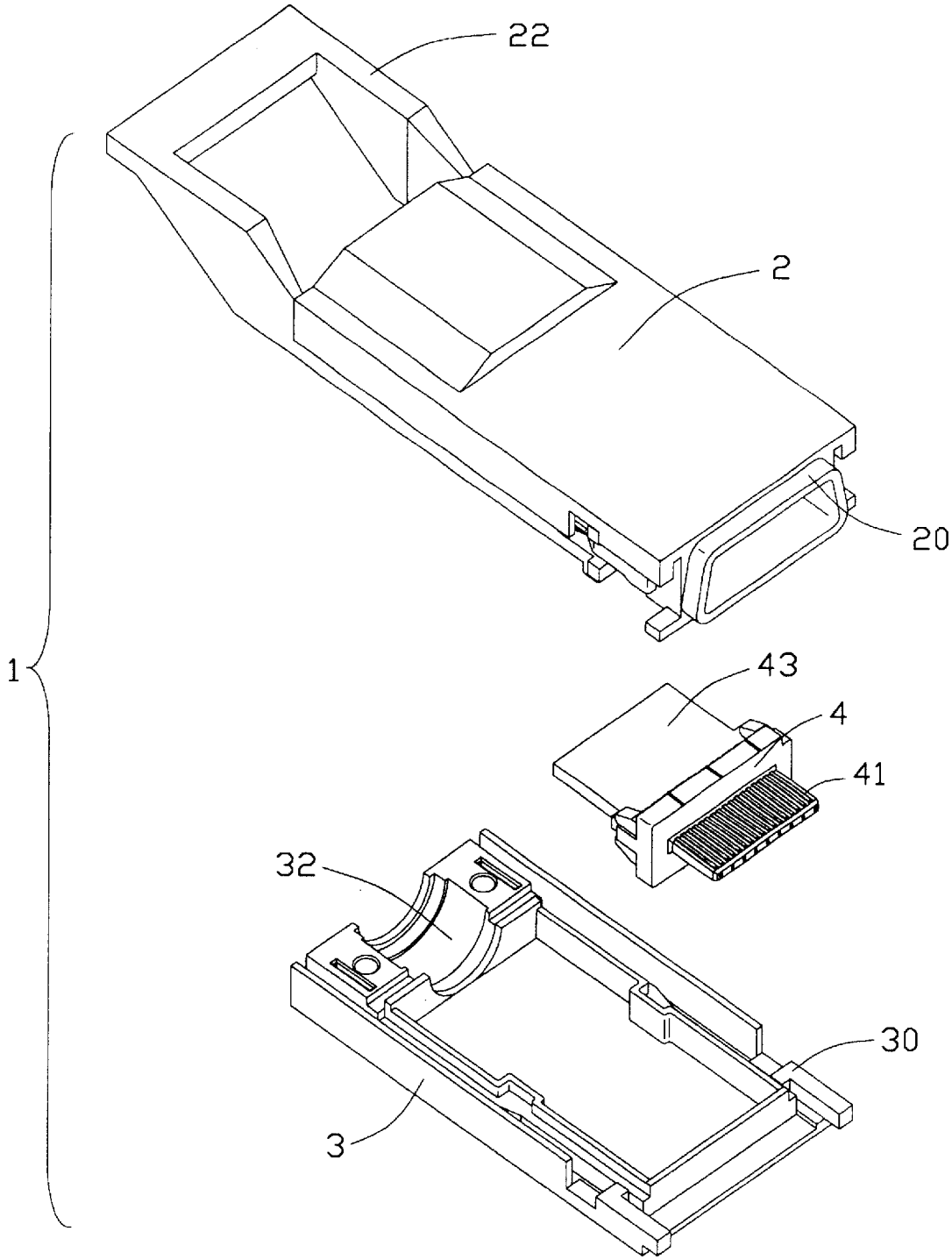
FIG. 2 is an explored view of the electrical connector shown in FIG. 1.

Referring to FIGS. 1 and 2, an electrical connector 1 in accordance with the present invention comprises a bottom housing 3, an upper housing 2, and a terminal module 4 located between the upper and bottom housings 2 and 3. The upper housing 2 defines a mating port 20 and a push bar 22 at opposite ends thereof. The bottom housing 3 defines an ejector mechanism 30 for retention of a complement connector (not shown), and an opening 32 for extension of a cable at rear portion thereof.

Figure 3:
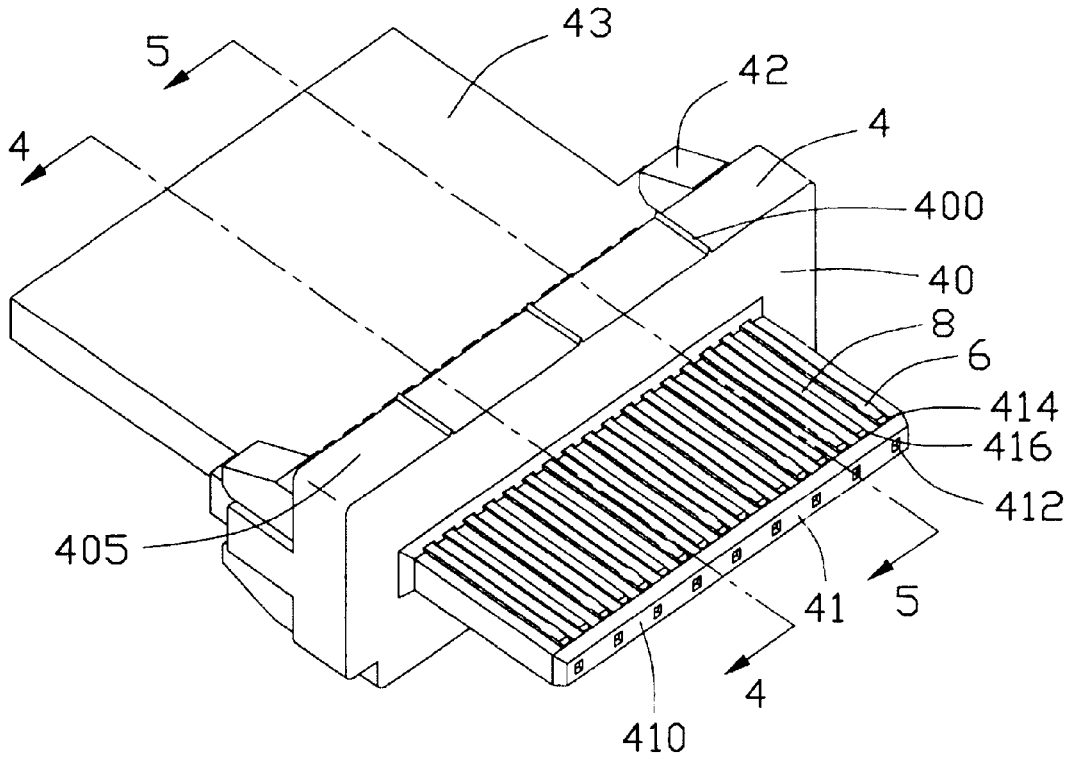
FIG. 3 is a perspective view of a terminal module of the connector.

Referring to FIG. 3, the terminal module 4 comprises a base 40, a tongue 41 projecting forward from the base 40, a pair of leading arms 42 extending from both sides of the base 40, and an inner circuit board 43 disposed between the pair of leading arms 42 and adjacent to rear portion of the base 40. The base 40, forms a plurality of protrusions 40, beyond an upper surface 405 thereof, and a pair of ribs 401 extending rearward therefrom. The ribs 401 further define a rear surface 402. The tongue 41 defines a front surface 410 parallel to the rear surface 402. A plurality of through grooves 414 are defines in the tongue 41, and a plurality of grooves 416 are formed between every two adjacent through grooves 414 and at both side of the tongue 41.

Figure 4:
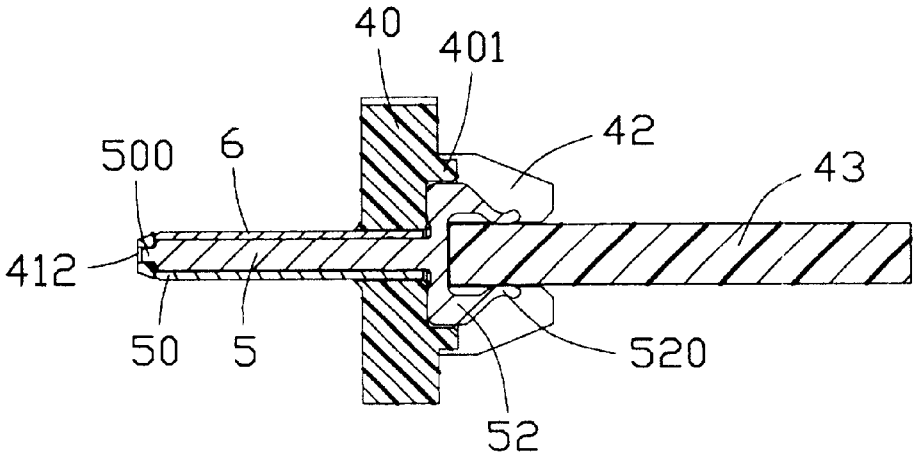
FIG. 4 is a cross-sectional view of the terminal module taken along line 4—4 of FIG. 3.
Figure 5:
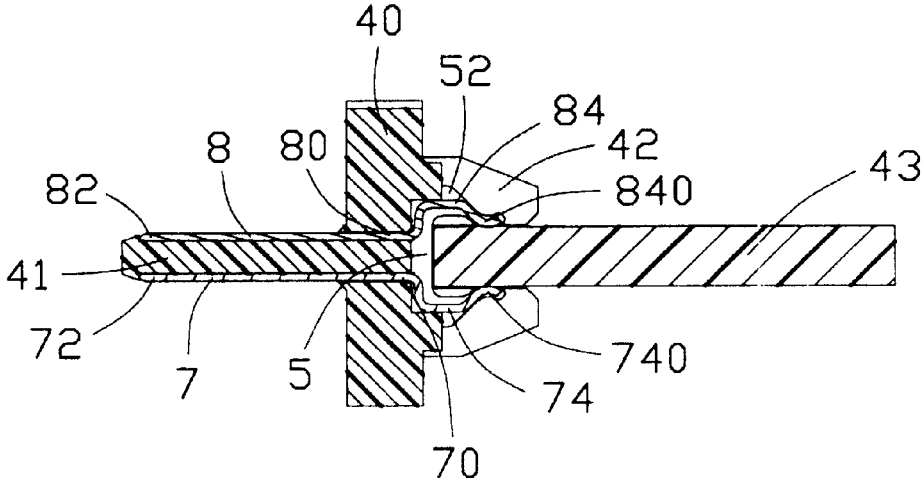
FIG. 5 is a cross-sectional view similar to FIG. 4 but taken along line 5—5 of FIG. 3.
Figure 6:
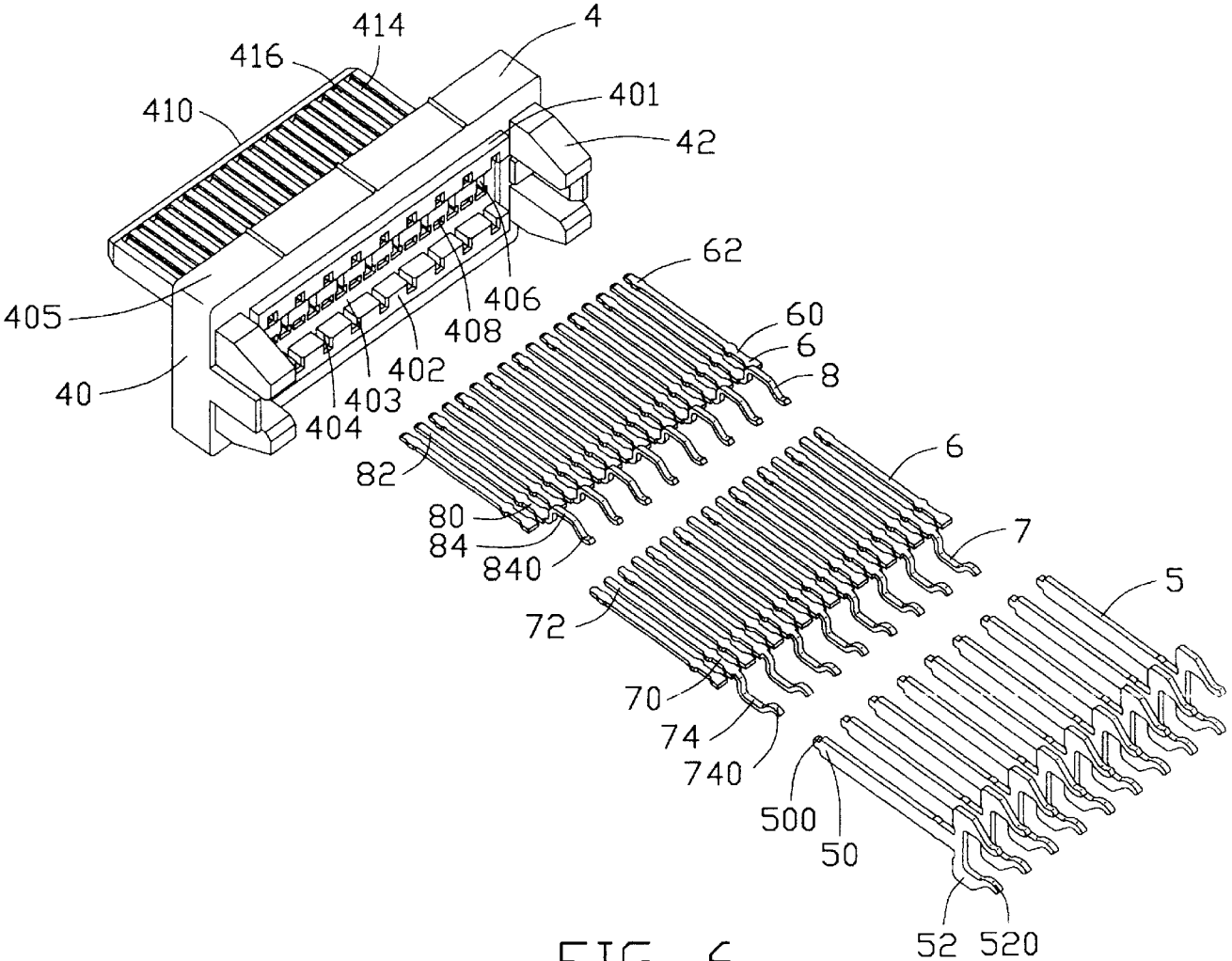
FIG. 6 is an explored view of the terminal module but circuit board being removed.

Referring to FIGS. 4–6, each rib 401 forms a plurality of recesses 404. The base 40 further defines a receiving cavity 403 between the pair of ribs 401 at rear portion thereof. A plurality of passageways 406 are formed through the base 40 and communicate with corresponding through grooves 414, and a plurality of passages 408 are formed through the base 40 and communicate with corresponding grooves 416. Specially, each recess 404 is aligned with corresponding passageways 406 in a vertical direction. Each passageway 406 has a smaller width at middle portion and has bigger width at both ends thereof. Furthermore, the tongue 41 defines a plurality of holes 412 to provide each through groove 414 an opening to the front surface 410. The through grooves 414 and the passageways 406 together define a contact-receiving space for receiving grounding terminals, and the grooves 416 and passages 408 together define a contact-receiving space for receiving signal terminals.

Terminals are received in the terminal module 4 and include first grounding terminals 5, second grounding terminals 6, first signal terminals 7 and second signal terminals 8. Referring to FIG. 6 please, each first grounding terminal includes a limb 50 and a pair of wings 52 extending from an end of the limb 50, and the limb 50 defines a tip 500 at opposite end thereof. Each wing 52 defines an engaging portion 520. Each second grounding terminal 6 includes a retention portion 60 for retaining the terminal 6 in the terminal module 4, and a contact portion 62 for engaging the circuit board 43. Each first signal terminal 7 includes a retention portion 70, and a contact portion 72 and a curved portion 74 extending in opposite directions and from the retention portion 70. The curved portion 74 further defines an engaging portion 740 for connecting the circuit board 43. Each second signal terminal 8 includes a retention portion 80, and a contact portion 82 and a curved portion 84 extending in opposite directions and from the retention portion 80. The curved portion 84 further defines an engaging portion 840 for connecting the circuit board 43. In addition, the length of the second grounding terminals 6 is equal to the length of the retention portion plus the contact portion of each first and second signal terminal 7 and 8. Furthermore, in assembly, the contact portion of the second grounding terminals 6 and the first and second signal terminals 7 and 8 has flat shape and is arranged in a plane which is parallel to the upper surface 405 of the base 40, while the limb 50 of the first grounding terminals 5 has also flat shape but being arranged in a plane which is perpendicular to the upper surface 405 of the base 40. In order to improve impedance of the terminals, the contact portions must be plated a layer gold. Regarding to cost of plating, only ends of the contact portions are plated a layer gold here.

Figure 7:
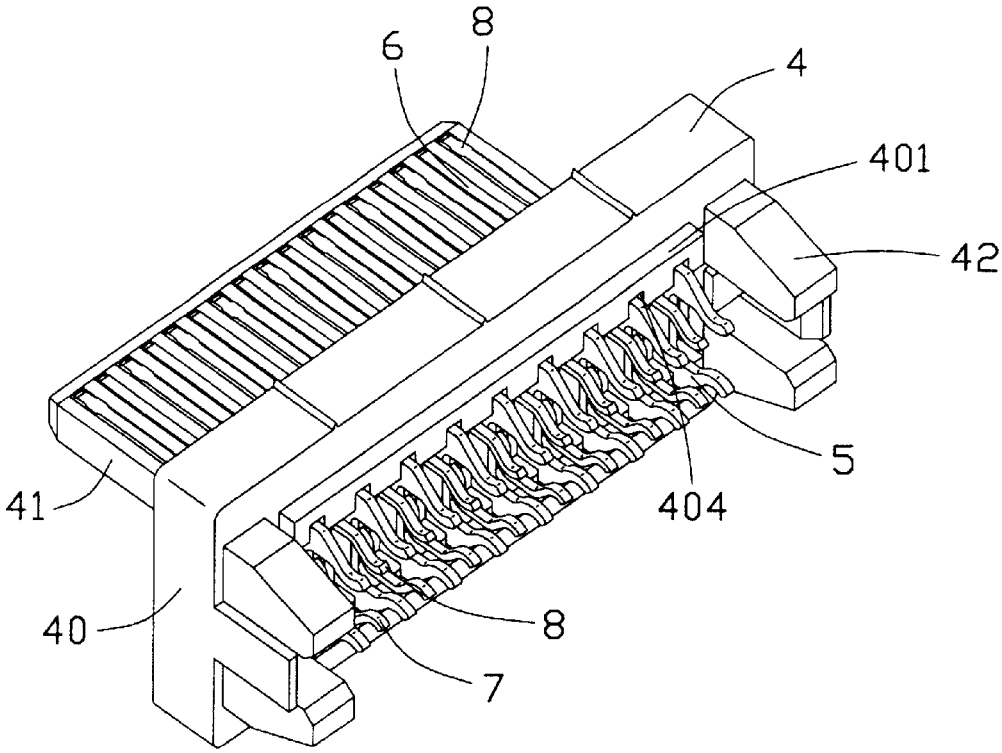
FIG. 7 is a perspective view of the terminal module, showing a number of elements of FIG. 6 assembled together.

Referring back to FIGS. 4 and 5 in conjunction with FIGS. 6 and 7, in assembly, the second grounding terminals 6 are firstly inserted into the passageways 406 of the base 40 and further entirely in the through grooves 414 of the tongue 41 in pairs. The first and second signal terminals 7 and 8 are inserted into passages 408 of the base 40 and further in the grooves 416 of the tongue 41. The flat contact portions 62, 72 and 82 are arranged in both side of the tongue 41 thereby providing enough surfaces for mating with the complement connector. Subsequently, the first grounding terminals 5 are inserted into the passageways 406 of the base 40 and further into the through grooves 414 until the tip 500 extends into corresponding hole 412 of the tongue 41, wherein the limb 50 engages every adjacent pair of first grounding terminals 5 and the wings 52 are retained in the recesses 404 to prevent unnecessary deformation. Then the wings 52 of the second grounding terminals 5, and the curved portions 74 and 84 of the first and second signal terminals 7 and 8 are disposed in the receiving cavity 403 of the base 40 and beyond the rear surface 402. Thus, the circuit board 43 can be retained between the pair of leading arms 42, and between the wings 52 and the curved portions 74 and 84 via interfering with the engaging portions 520, 740 and 840. Finally, in insertion direction and perpendicular to the upper surface 405, the wings 50 each has bigger surface relative to the curved portions 74 and 84 thereby providing better grounding protection for signal transmission.

Referring back to FIG. 1 and 2, the terminal module 4 is entirely received in a space defined by the upper and bottom housings 2 and 3, wherein the tongue 41 extends in the mating port 20. The ejector mechanism 30 provides a way to exit the complement connector. A cable (not shown) can extend through the opening 32 and further contact with the circuit board 3 of the terminal module 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a bottom housing;

an upper housing assembled to the bottom housing together to define a space and a mating port positioned near the space; and a terminal module received in the space defined by the upper and bottom housings, the module having a base, a tongue extending in the mating port from the base in a mating direction, and a plurality of signal terminals and grounding buses therein, said grounding buses comprising first grounding terminals for engaging with a mating connector and second grounding terminals for shielding the signal terminals;

wherein the tongue defines a plurality of through grooves and grooves for respective receipt of the grounding busses and the signal terminals;

wherein the through grooves and grooves of the tongue are arranged alternatively to each other;

wherein the tongue further forms a plurality of holes to provide support for the first grounding terminals;

wherein each of the first and second grounding terminal defines a contact portion in the tongue and a retaining portion in the base, and each second grounding terminal further includes a pair of wings extending outside of the base from the retention portion;

wherein each contact portion of the second grounding terminals defines a tip to cooperate with a corresponding hole of the tongue.

2. The electrical connector as claimed in claim 1, wherein each signal terminal has a retention portion, a contact portion received in a corresponding groove and a curved portion extending outward from the retention portion.

3. The electrical connector as claimed in claim 2, wherein each wing has bigger surface than that of the curved portion of the signal terminal.

4. The electrical connector as claimed in claim 1, wherein the base defines a plurality of passageways communicating with the through grooves to receive grounding terminals, and passages communicating with the grooves to receive grounding buses.

5. The electrical connector as claimed in claim 4, wherein each first grounding terminal and two corresponding second grounding terminals are received in a same passageway.

6. The electrical connector as claimed in claim 1, wherein the base defines a plurality of recesses at a portion which is against the mating direction for retention of the second grounding terminals.

7. The electrical connector as claimed in claim 1, wherein both the first grounding terminals and signal terminals have flat surface for reliable engagement with a complement connector.

8. The electrical connector as claimed in claim 1, wherein the terminal module further comprises a circuit board engaging with the second grounding terminals and signal terminals.

9. An electrical connector comprising:

a terminal module having a plurality of signal terminals and grounding buses therein, said terminal module defining a base and a tongue projecting forward from the base, said base and tongue together defining a plurality of receiving spaces for receiving the signal and grounding buses, said grounding buses including first grounding terminals for engaging with a mating connector and second grounding terminals for shielding the signal terminals; and a shell enclosing the terminal module and defining a connecting port for insertion of an external element wherein the terminal module further comprises a circuit board disposed opposite to the tongue;

wherein each second grounding terminals contacts and engages a pair of first grounding terminals;

wherein the base forms a plurality of recesses adjacent the circuit board for retention of the second grounding terminals;

wherein the tongue defines a plurality of through grooves and grooves alternatively to each other for respective receipt of the grounding busses and the signal terminals.

10. The electrical connector as claimed in claim 9, wherein the electrical connector further has a push bar extending from the shell and an ejector mechanism for exiting a mating connector.

* * * * *